United States Patent [19]

Conn et al.

[11] Patent Number: 4,871,354

[45] Date of Patent: Oct. 3, 1989

[54] WET-DRY BAG WITH LYPHOZATION VIAL

[75] Inventors: Kirk O. Conn, Cogan Station; William Finlay, Jr.; Caroll S. Sutyn, both of Montoursville; Michael G. Maietta, Cogan Station, all of Pa.

[73] Assignee: The West Company, Phoenixville, Pa.

[21] Appl. No.: 197,307

[22] Filed: May 23, 1988

Related U.S. Application Data

[63] Continuation of Ser. No. 889,004, Jul. 24, 1986, abandoned.

[51] Int. Cl.[4] ..... A61J 1/00; B65D 25/08

[52] U.S. Cl. ..... 604/89; 604/416; 206/222; 141/114; 141/313

[58] Field of Search ..... 604/56, 82, 88–92, 604/410, 408, 414–416; 141/114, 313, 348, 349, 364; 206/221, 222

[56] References Cited

U.S. PATENT DOCUMENTS

| | | | |
|---|---|---|---|
| 3,857,392 | 12/1974 | Ogle | 604/91 |
| 4,410,321 | 10/1983 | Pearson et al. | 604/416 |
| 4,467,588 | 8/1984 | Carveth | 604/410 |
| 4,507,114 | 3/1985 | Bohman et al. | 604/416 |
| 4,515,586 | 5/1985 | Mendenhall et al. | 604/92 |
| 4,550,825 | 11/1985 | Sutryn et al. | 206/221 |
| 4,583,971 | 4/1986 | Bocquet et al. | 604/82 |
| 4,606,734 | 8/1986 | Larkin et al. | 604/88 |
| 4,607,671 | 8/1986 | Aalto et al. | 604/415 |
| 4,610,684 | 9/1986 | Knox et al. | 604/416 |
| 4,614,267 | 9/1986 | Larkin | 604/415 |

*Primary Examiner*—Dalton L. Truluck

*Attorney, Agent, or Firm*—Eugene E. Renz, Jr.

[57] ABSTRACT

A composite medicament container including a vial to contain a dry powdered medicament, an outlet opening in the vial, a Lyo-stopper closing and sealing the outlet opening, and a flexible liquid container to contain a diluent for the dry medicament. The liquid container has a discharge port having an ellipsoidal shape. There is a closure plug in the discharge port. The closure plug has an ellipsoidal configuration and a size to mate with the interior of the discharge port and be secured therein. The configurations and sizes of the discharge port and said closure plug co-act to provide an enlarged, closely contacting extensive scaling area. The vial opening has a circular external configuration so that the vial outlet opening and the liquid container closure plug are mateable. Also included is a composite interengaging and sealing means which is operatively attaching and sealing the containers in mated relationship for intermixing the materials therein.

8 Claims, 3 Drawing Sheets

WET-DRY BAG WITH LYPHOZATION VIAL

This is a continuation of application Ser. No. 889,004 filed July 24, 1986, now abandoned.

GENERAL TECHNICAL FIELD

The invention relates broadly to dispensing containers for medicaments and more particularly to a multicompartment, wet/dry bag with lypholization vials. Initially a dry medicament is in one separately sealed compartment consisting of a glass vial, and a diluent or fluid mixture therefor is in a second separately sealed compartment, consisting preferably of a flexible plastic material.

Such multicompartmented containers are broadly known in the art. Many different types of construction have been utilized, but heretofore some difficulties have been encountered in effecting seals of the individual containers or compartments, and in general, storage difficulties have been encountered by breakdowns in the respective sealing means and/or vaporization or transmission of liquids and fluids which tend to destroy or, in any event, lessen the effectiveness of the medicament to be dispensed, and especially as used in connection with I.V. administration of the medicament.

The prior art encountered difficulties in structures permitting separately fillable compartments or separate containers, which were thereafter interconnected for permitting administration of a mixed medicament consisting of a dry medicament and a fluid or liquid diluent therefor. The prior art also encountered difficulties in selective storage of dry medicaments in a container, including a sealed medicament compartment, and a flexible plastic container having a diluent for mixing with the medicament in a sterile, non-contaminated condition for I.V. dispensing, or hypodermic removal, which constitute the main field and use of structures similar to the present invention.

The present invention is, therefore, directed to structures of multicomponent containers which tend to lend to overcome difficulties in prior art structures and to provide a highly efficiency, wet/dry bag in combination with medicament lypholization vials, the bags being constructed of plastic materials and the lypholization vials being of glass. Particular emphasis is directed to the interjoining of the two compartments or containers. The dry medicament powder is contained normally in standard glass vials to allow lypholization via standard, in-place lypholization lines. As will be described in more detail hereinafter, the present invention is directed to a glass vial of, for example, a 30 ml capacity, of powder, and the vial is attached to a flexible plastic diluent container by means of an efficient sealing concept including an aluminum seal which can be secured by rolling about the juncture point and interconnection between the two members. A seal is also effected by use of an elastomeric gasket between the glass vial and a plastic port in the plastic diluent container. Movable plug structures close the flexible plastic container and also a stopper of highly resistant material being utilized both in the ports of the glass vial and the plastic diluent container. The stopper or seal unit consists of two plugs, one closeably and sealingly closing the members and the two compartments or containers when interconnected can be activated by movement of both stoppers such as by pushing both stoppers into the glass vial by selectively operable push rod means attached to or in contact with a lower one of the stoppers.

The flexible container is of a design or contour devised for increased efficiency of connection of an outlet port with the flexible body of the liquid container and a connection with the glass vial discharge neck. The different materials have sometimes presented difficulties of sealing juncture.

While a single embodiment incorporating the inventive aspects will be disclosed and described hereinafter and shown in the accompanying drawings, manifestly, minor detail changes will be apparent to those skilled in the art and without departing from the scope of the invention.

BACKGROUND OF THE INVENTION

Multicomponent containers adapted for initially holding in separate compartments, two or more substances or materials such as medicaments, one being dry, and the other a liquid diluent or carrier solution for such dry components, have been known and used. A specific example of such a compound container of this general nature is disclosed in U.S. Pat. No. 4,550,825, assigned to a common assignee with the present application. Other examples of multicompartment medicament dispensers are, for example, disclosed in U.S. Pat. No. 4,410,321, issued Oct. 18, 1983. Numerous other examples are found in the prior art but many included one or more drawbacks in manufacture processing, effective long-life sealing of the individual containers or compartments, and a composite or compound unit being effectable by manufacture of the individual components in separate manufacturing or process lines, such containers being separately fillable with dry medicaments and diluents therefor and the individual containers being separately, if desired, stored and in some instances being effectively conjoined one with another for use or utilization by dispensers of the medicaments in I.V. systems or the like, such interconnected and sealed separate containers, when actively interjoined for storage, shipment, and use, being highly efficient and overcoming drawbacks in prior non-constructions.

In effecting or manufacture of a structure incorporating the present inventive concepts, a vial of glass is filled with a desired amount of powdered medicament and individually sealed, and a flexible container of plaastic material is filled selectively with a diluent and individually sealed in a sterile manner as is the powder container. The two containers are actively interconnected by seal means including an aluminum seal consisting of a pliable aluminum strip which is rolled over the juncture of the two separate and separely sealed containers.

The so-joined separate containers also preferably include hanger means operatively attached to the glass powder medicament container, and which can include labeling means for identification purposes and such labels can be removably mounted if desired. The seal between the two containers having the rolled aluminum seal is further enhanced or effected by incorporation therebetween of an elastomeric material gasket between glass and plastic material ports. A movable plug closes the flexible container and a so-called Lyo-stopper closes the port in the glass vial.

Means are included for effecting intercommunication of the liquid with the powdered medicament by pushing or moving both stoppers into the glass vial by means such as a push rod attached to or in contact with the stopper in the plastic diluent container.

Another of the problems heretofore existing in the interconnection of glass containers with plastic material containers resided in or was related to the use of adequate vapor barrier means in the two different material containers. The present invention utilizes for such vapor barriers, and sterile closure means, two plugs instead of a single one such as in some of the prior art structures and which were pierced or forced out of a port to effect intermixture. The two separate closure plugs constituting separate vapor barriers overcomes a problem of sealing capability over extended periods of time.

The present invention significantly is of a design to effect a good sealing of a plastic bag to a glass container, both the glass bottle or container with its own separate stopper is joined to a plastic neck on the plastic flexible diluent container bag, and the structure and materials are such that the two can be joined together by heat and/or sonic means and the like. Each of the containers is individually sealed and the two initially sealed containers are joined together by composite sealing means with aluminum flexible material spun over the juncture point therebetween, resulting in a compound unit of exceptional effectiveness, long lasting sealing, and both components of which can be produced in separate production lines, separately stored and thereafter effectively interconnected or joined and activated in an I.V. system with good and high effectivity, and in the absence of contamination or effective actuation of the medicament material as intermixed for use in such dispensing or introduction methods or systems.

Very broadly, in the preferred embodiment hereinafter described in detail, and as shown in the drawings, the basic concept of the invention is disclosed. A separate glass dry medicament or drug container is formed in a usual manner, and a plastic material diluent holding bag which is resilient is composed of two layers or sides of plastic material heatedly or otherwise appropriately interconnected. A resilient closure plug is fitted into the interior of the outlet port of the glass vial, and a port is formed in the plastic diluent structure by an elliptical or ellipsoidal-shaped plastic inert, which is inserted into the opened port of the flexible bag and appropriately sealed therein. The overall structure overcomes the problems encountered in joinder of glass with plastic materials by utilization of the elliptical portion of the plug in the diluent container bag. The use of the plastic ellipsoidal-shaped insert in the bag discharge port of a plastic material facilitates adherence of the plug and interconnection with the glass container through the aformentioned sealing means. Adhesion or affixing can utilize suitable adhesives, heat sealing and/or other known methods.

Broadly speaking, therefore, the present invention incorporates two separate material containing structures which are individually producible along separate production lines and each has a suitable closure plug, and means such as a push rod plunger actuator is incorporated in the plastic bag which, upon being displaced, will also displace the individual seals or plug members of the two containers for movement into the glass vial, and the diluents and dry medicament are thereafter permitted to intermix with no fragmentation or contamination.

Other objects and advantages of the present invention will become readily apparent from the following detailed description, wherein there is shown and described a preferred embodiment of the invention, simply by way of illustration of a preferred and presently contemplated mode for carrying out the invention. As will be realized, the invention is susceptible to minor modifications in various, obvious respects, all without departing from the invention. The drawings and description are to be regarded merely as illustrative in nature and not as restrictive.

BRIEF DESCRIPTION OF THE DRAWINGS

The present invention and the various features and details of the operation and construction thereof are hereinafter more fully set forth with reference to the accompanying drawings, wherein.

Figure 1:
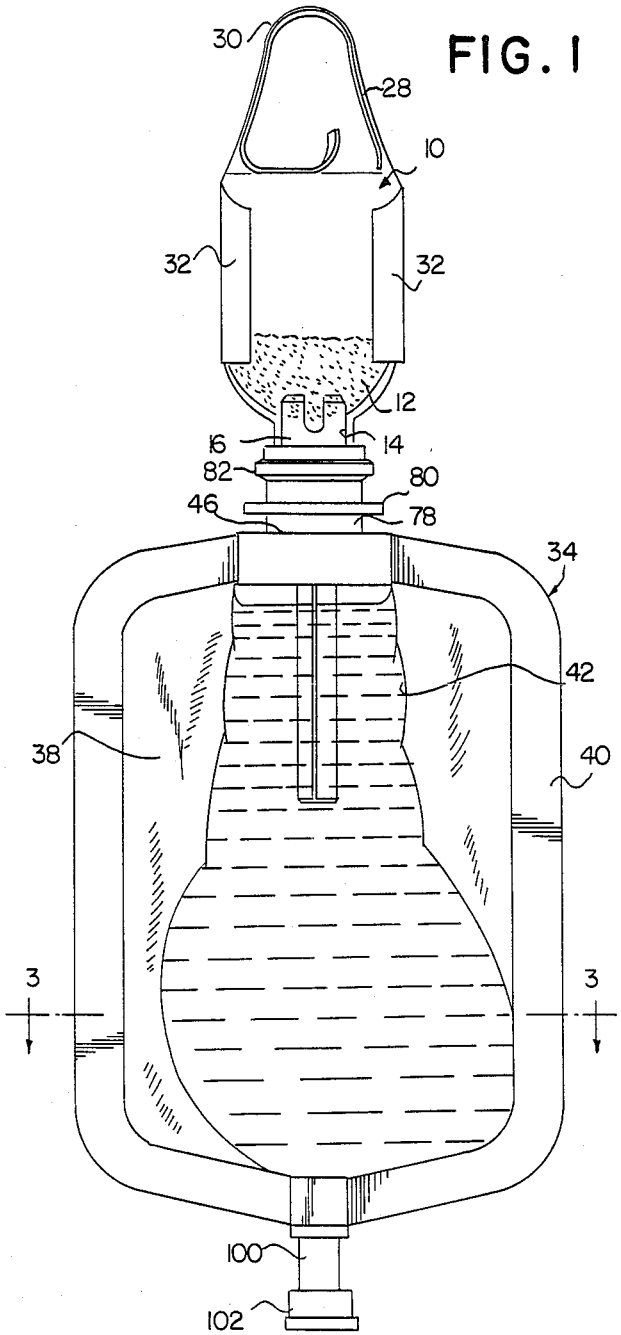
FIG. 1 is a front elevational view showing details of one form of the invention incorporating an integrated composite of a container of dry medicament and a plastic container holding a liquid or fluid, the dry medicament and liquid or fluid thereafter to be intermingled by means known in the art and dispensed into a patient.
Figure 2:
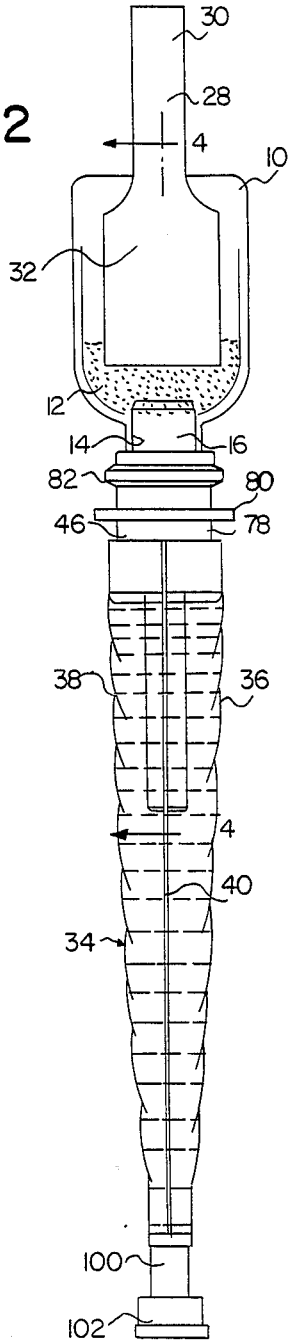
FIG. 2 is a side elevational view of the device shown in FIG. 1.
Figure 3:
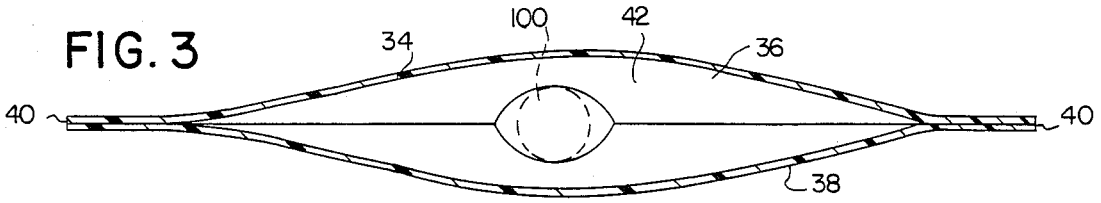
FIG. 3 is an enlarged sectional plan view taken on line 3—3 of FIG. 1 and showing details of the fluid-containing plastic bag, and showing in greater detail constructional features of a bonding at the edges of the plastic bag and, at the bag bottom, an ellipsoidal-shaped plug for the insertion of an I.V. line.

As hereinbefore mentioned, the diluent container is provided with a discharge fitting 46. This discharge fitting 46 has one terminal end of an ellipsoidal configuration, and consists of a plastic material. Appropriate seal means such as an adhesive 48 serves to integrate this fitting in the discharge end of container 34. Obviously, the materials used are such that a good and effective juncture or joining of the members is incorporated. The fitting 46 includes a central bore 50 as shown more clearly in FIGS. 4 and 5 and terminates in an enlarged upper discharge opening 52. A plunger rod 54, of plastic material or the like, and of general X-shaped configuration is inserted and extends through the central bore and includes an upper and having the configuration of a maltese cross of larger diametrical dimensions than the diameter of the bore 50. The ends of the maltese cross rest on a ledge or shoulder 58 formed at the juncture between the two bores. This serves to maintain the plunger rod in the appropriate position.

The enlarged upper bore portion or discharge opening 52 has inserted therein a rubber closure and sealing plug 60, which is hemispherical in shape, and consists of a suitable resilient rubber material not subject to rapid deterioration by materials such as in the medicament containers. It will be seen from FIG. 4 that this closure and sealing plug 60 tightly fits within the discharge opening 52 but has contact mainly at the outer extended periphery 62. The small area of interengagement is to permit a displacement of this plug or closure member from the discharge opening as desired and which will be explained hereinafter. A hemispherical recess 64 likewise serves to facilitate flexure of the sealing plug to facilitate placement and sealing engagement thereof within the discharge port. It is noted that the upper edge 66 serves as a contact ring with the outer end of the Lyo-stopper 16 engaged in the discharge port of the glass vial 10. This contact serves to effect an opening of the two containers upon actuation of the pusher or plunger rod 54 in the direction indicated by an arrow 68 in FIG. 6. An appropriate pressure can be applied to the lower end 70 of plunger rod 54 from the exterior due to the flexibility of the plastic container for the diluent.

Figure 6:
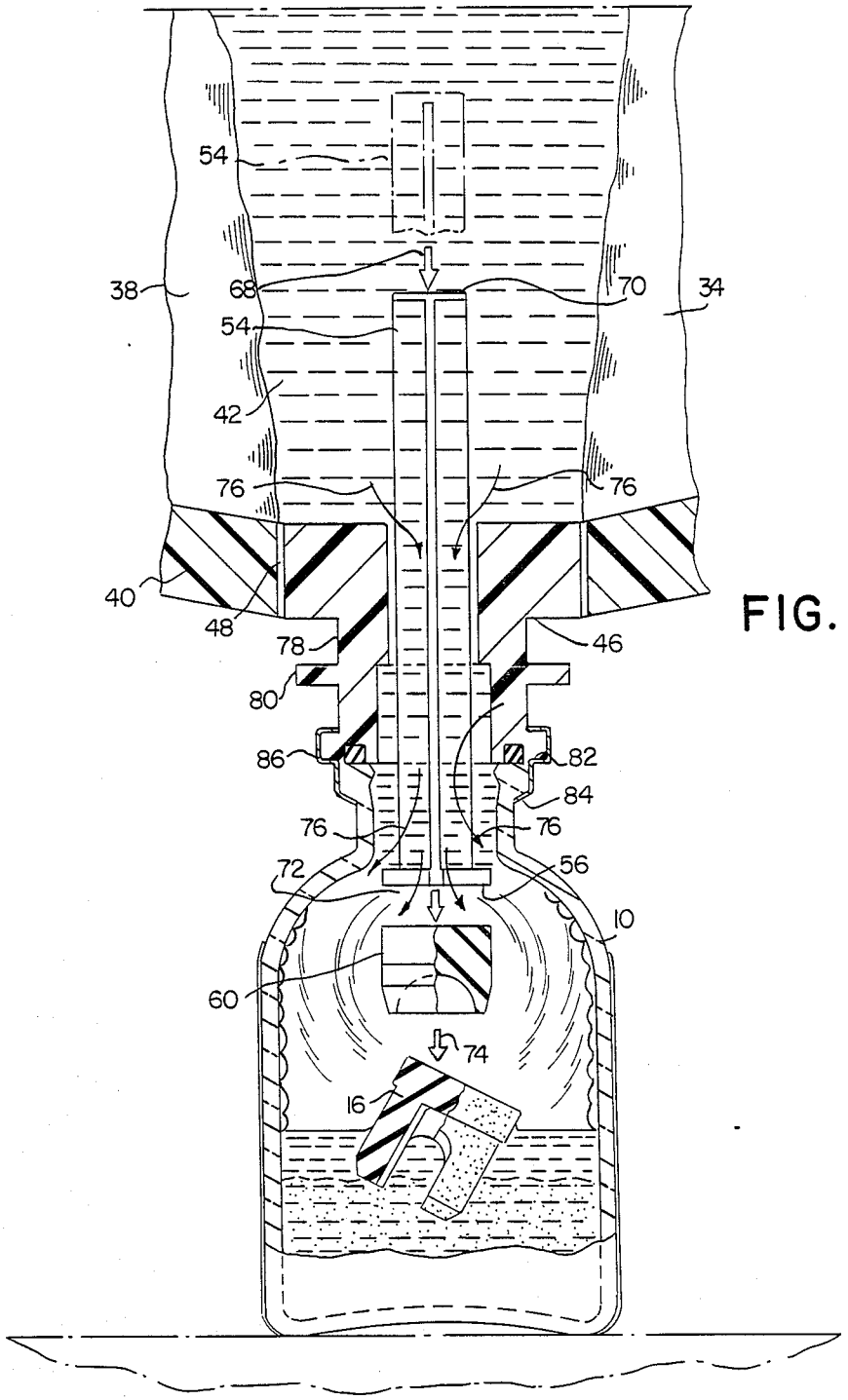
FIG. 6 is a fragmentary, sectional elevational view similar to FIG. 4 but in an actuating mode illustrating the method of intermixing the dry medicament with liquid, as will be described in greater detail hereinafter.

The resultant action is diagrammatically shown in FIG. 6. When the rod 54 is pressed down in the direction of arrow 68 it will displace the Lyo-stopper 16 out of the neck of the glass vial into the interior of the vial and this is accomplished by contact between the plunger rod end 56 with the end of the rubber plug 60 which in turn is in pushing engagement with the top of the Lyo-stopper 16. The arrows 72, 74 indicate the action following pushing of the rod in this manner. The resulting action opens the discharge part from the plastic bag constituting the liquid or diluent container 34, and a passageway indicated by arrows 76 are diluent flow indicators showing the liquid diluent discharged into the glass vial for intermixing. In the usual manner, a kneading or shaking of the combined structure will appropriately intermix the liquid and dry medicament material. The combination can then be appropriately suspended from or by the loop 30 for I.V. dispension.

It is noted that the fitting or closure 46 is elliptical in configuration and has a circular or cylindrical portion 78 extending thereabove and incorporating an enlarged circular flange 80 thereon. This enlarged flange 80 can serve as a retainer or manipulator in a final sealing interengagement between the various members. To this end, a stepped cylindrical collar 82 of thin aluminum material is rolled over and around the intermated or intermeshed edges of the discharge openings of the two containers into a sealing arrangement and interengagement as indicated at 84 in FIGS. 4 and 6. The rolling of this sealing strip is known in the art per se.

Figure 4:
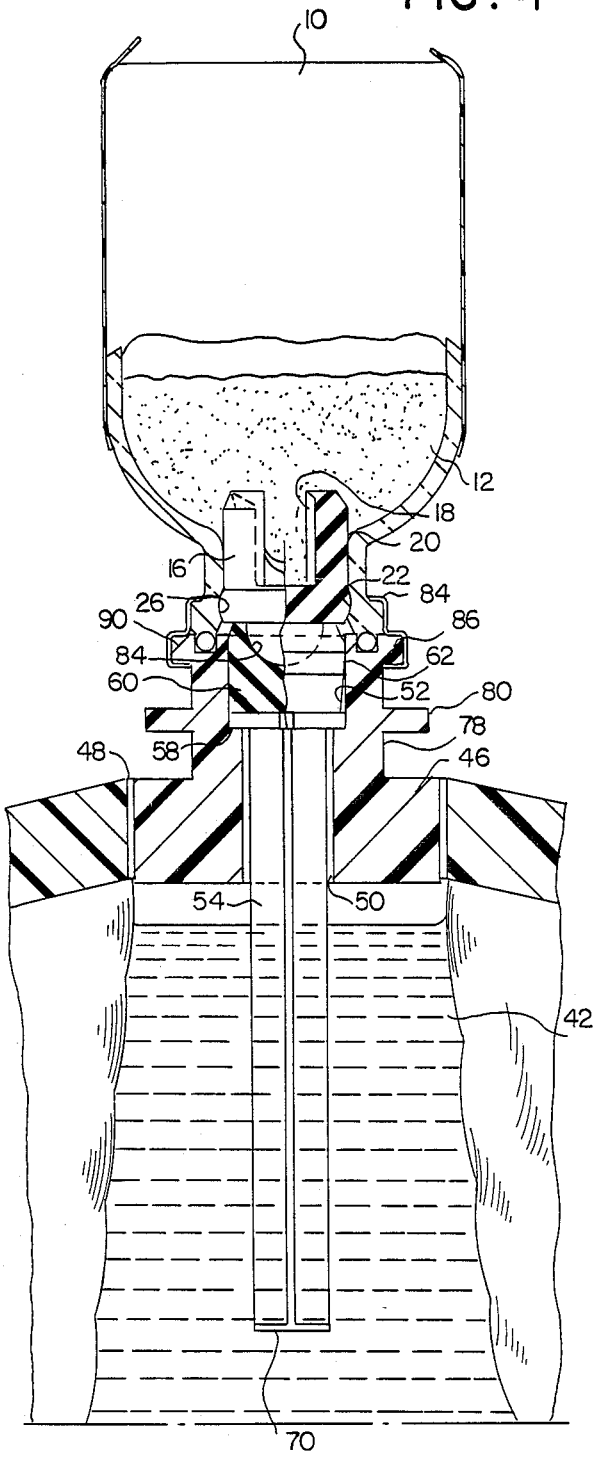
FIG. 4 is an enlarged fragmentary sectional elevational view taken on line 4—4 of FIG. 2, showing additional details of construction and particularly related to the sealable connecting means between the glass via of dry medicament and the fluid containing bag.
Figure 5:
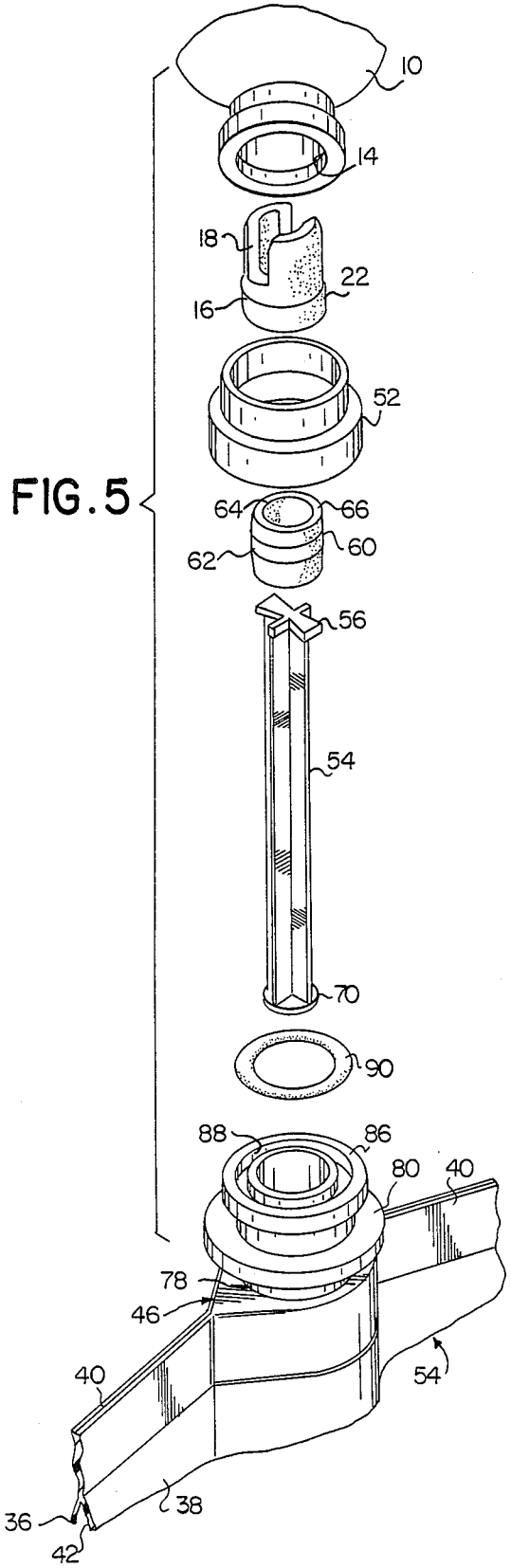
FIG. 5 is an exploded view showing in perspective the elements illustrated in FIG. 4.

Attention is directed to FIGS. 4 and 5 for another portion of the sealing arrangement. The upper end or flange 86 of the fitting member 46 has a recessed circular groove 88 therein in which is placed an O-ring 90 of elastimeric material and this, at its top surface, interengages with the top surface of and around the discharge opening of the glass container. When the aluminum strip is appropriately rolled about this interengagement of portions of the two containers, there is effected a tight and effective sealing interengagement which will effectively prevent vapor or vaporization transfer or emmission from and into or between the interengaged containers.

It is also noted that the lower terminal end of the flexible container 34, has a pierceable fitting 100 centrally located and sealably bonded to the flexible container, for the interconnection of an I.V. line or the addition of an additional medicament, the lower end of fitting 100 is protected from contamination by cap 102.

While a single embodiment has been shown and described, it is obvious that minor changes can be made without departing from the spirit and scope of the invention as defined in the appended claims.

What is claimed is:

1. A composite medicament container comprising a first vial member for a first component of the medicament, an outlet opening in the vial, a closure member slidably mounted in said outlet opening for normally sealing said outlet opening, a flexible container member having a discharge outlet fitting with a port and a plug member for the port, means mounting said closure and plug members so that the outlet opening and port are axially aligned and plunger rod means disposed completely interiorly of said flexible container member cooperatively associated with said closure and plug members actuatable axially to a discharge position to displace said closure and plug members into said first vial member and thereby establish fluid communication between said first and second members, guide means for guiding said plunger rod means during actuation thereof axially to said discharge position, said plunger rod means being of a cross-sectional configuration to permit fluid flow around the periphery of said plunger rod whein in said discharge position, the diameter of said closure member being greater than the diameter of said plug member and said plunger rod manipulatable externally of said flexible container to actuate the same axially and engageable with said plug member to ensure displacement of both said closure and plug member into said first vial member.

2. A composite medicament container as claimed in claim 1, wherein said plug member is of a smaller diameter than said closure member to allow for axial displacement of both members into said first vial.

3. A composite medicament container as claimed in claim 1, wherein said outlet in said first vial has a circumferentially extending indentation providing a seat and seal for the closure member.

4. A composite medicament container as claimed in claim 1, including a rigid discharge fitting for the discharge port of said flexible container which confronts the outlet of said first vial and seal means between said discharge fitting and said first vial.

5. A composite medicament container as claimed in claim 4, wherein said discharge fitting and said first vial have radially outwardly projecting flanges and a one-piece member securing the vial member and container by said flanges.

6. A composite medicament container as claimed in claim 1, wherein said plunger rod is of cross section different than said port cross section to allow flow between said plunger rod and said port.

7. A composite medicament container as claimed in claim 1, including means mounting said plunger rod for limited axial movement in said port in a predetermined manner preventing full displacement thereof into said flexible container.

8. A composite medicament container as claimed in claim 7, wherein said port is of stepped configuration defining a shoulder along its length and wherein said plunger rod has an enlarged portion engageable with said shoulder to limit axial movement of said plunger rod.

* * * * *